United States Patent [19]

Lacombe-Allard

[11] 3,943,702

[45] Mar. 16, 1976

[54] APPARATUS FOR THE CONTINUOUS PRODUCTION OF LINK CHAINS

[75] Inventor: Jean-Francois Lacombe-Allard, Sens (Yonne), France

[73] Assignee: Automatisme & Technique, Arcueil (Val de Marne), France

[22] Filed: Nov. 21, 1974

[21] Appl. No.: 525,893

[30] Foreign Application Priority Data

Dec. 5, 1973 France ..... 73.43521

[52] U.S. Cl. ..... 59/4; 59/7; 59/8; 59/12; 59/35 R

[51] Int. Cl.[2] ..... B21L 9/02

[58] Field of Search ..... 59/4, 7, 8, 5, 12, 35

[56] References Cited

UNITED STATES PATENTS

| | | | |
|---|---|---|---|
| 1,899,976 | 3/1933 | Müller | 59/7 |
| 2,831,316 | 4/1958 | Linde | 59/7 |
| 3,802,184 | 4/1974 | Brown et al. | 59/8 |

FOREIGN PATENTS OR APPLICATIONS

| | | | |
|---|---|---|---|
| 331,093 | 6/1930 | United Kingdom | 59/7 |

*Primary Examiner*—C. W. Lanham
*Assistant Examiner*—James R. Duzan
*Attorney, Agent, or Firm*—Seidel, Gonda & Goldhammer

[57] ABSTRACT

This invention relates to a method and apparatus for the continuous production of link-chains comprising alternate inner links and outer links, two inner links being connected by an outer link, each inner link being formed by a lower plate and by an upper plate, each of which is provided with two coaxial holes receiving a bush carrying a freely rotatable roller, each outer link comprising a lower plate and an upper plate joined by two pins inserted to pass through the corresponding bush of the inner link, to which the outer link is connected.

9 Claims, 53 Drawing Figures

FIG. 2
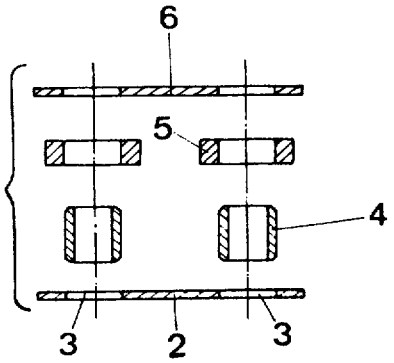
FIG. 1 B
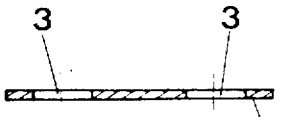
FIG. 1 A
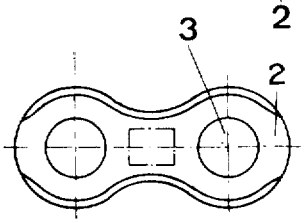
FIG. 4
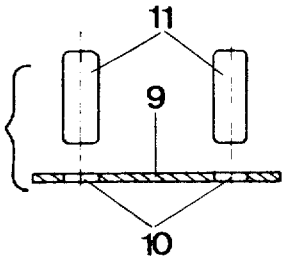
FIG. 3
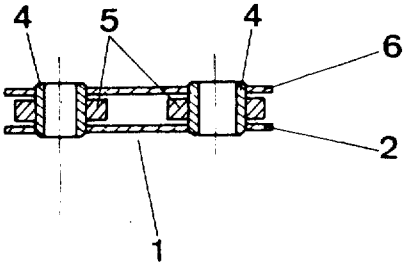
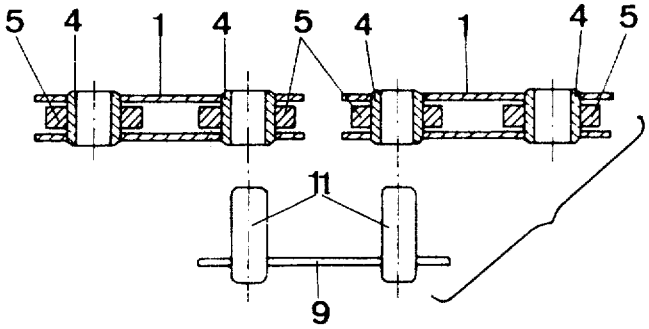
FIG. 5 a
b
c
c1
d
2
3
5
21
23
24
34

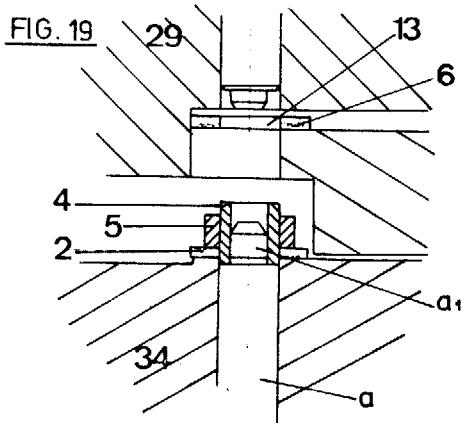
FIG. 19
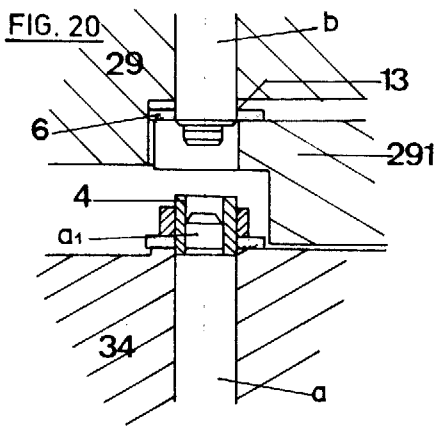
FIG. 20
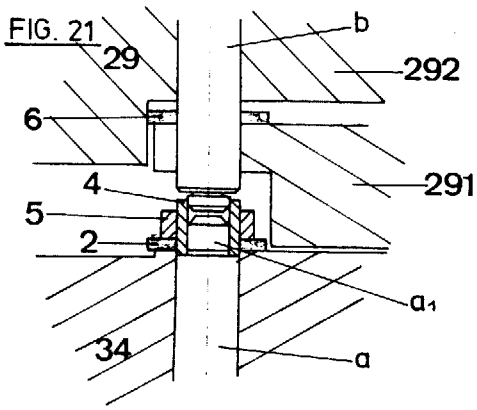
FIG. 21
FIG. 22
FIG. 23
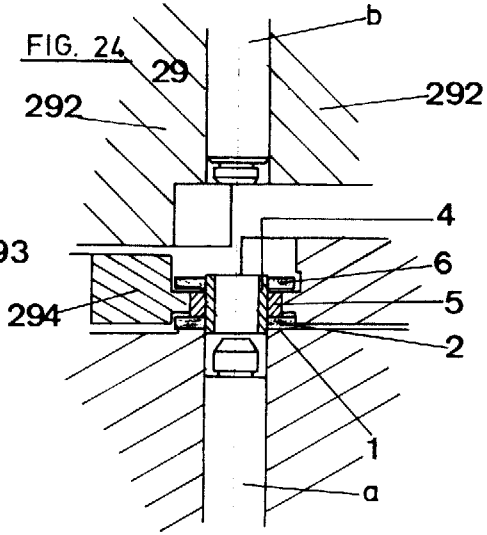
FIG. 24 b
1
9
11
521
523
524
52
54
540
541
542
543
4
12
13
55

APPARATUS FOR THE CONTINUOUS PRODUCTION OF LINK CHAINS

This invention relates to a method and apparatus for the continuous production of link-chains comprising alternate inner links and outer links, two inner links being connected by an outer link, each inner link being formed by a lower plate and by an upper plate, each of which is provided with two coaxial holes receiving a bush carrying a freely rotatable roller, each outer link comprising a lower plate and an upper plate joined by two pins inserted to pass through the corresponding bush of the inner link, to which this outer link is connected.

At present link-chains are manufactured in accordance with relatively small-scale processes leaving a large amount to manual labour, and this is undesirable in view of the high cost of labour.

The invention seeks to overcome this drawback and accordingly provides method for the production of chains composed of alternate inner links and outer links, two inner links being joined by one outer link, each inner link being formed by a first lower plate and a first upper plate, each of the plates being provided with two coaxial holes each receiving a bush carrying a freely rotatable roller, each outer link comprising a second lower plate and a second upper plate joined by two inserted pins passing through the corresponding bush of the inner link, the outer link being joined to the inner link, the method comprising the steps of assembling in a continuous kinematic arrangement the inner link starting with the first lower plate, by disposing two bushes on to which corresponding rollers are fitted, the assembly then being closed by means of the first upper plate and concurrently forming blanks of outer links each blank comprising a second lower plate and two inserted pins and then continuously joining together the inner links and the blanks of outer links by bringing the inner links one after the other at a distance apart corresponding in each case to an outer link, then fitting the inner links on to the pins of the blanks of outer links and finally closing the outer links by means of second upper plates.

The invention further provides an apparatus for the production of link chains by the above method, the apparatus comprising a machine for the manufacture of inner links, a machine for producing the blanks of outer links and an assembly machine for assembling the inner links and outer links and for completing the manufacture of the outer links, first and second transfer means being provided for bringing the inner links into association with the outer links for assembly in the assembly machine.

Thus, by using the method and apparatus according to the invention there are manufactured without interruption link-chains, and any intervention is restricted to the supplying of the various component parts of the links to the distributing or dispensing devices.

The division of the plant into three connected machines the first two of which manufacture the inner link and the blank of the outer link, respectively, and the third of which ensures the continuous joining of these different links, enables a particulalry flexible operation of the plant to be accomplished.

As the chain emerges continuously from the machine it could be advantageous to produce lengths of chain having a given length. To acheive this object there is omitted the forwarding of one outer-link blank, at the given moment, to the assembly machine. In this way, and without the machine being halted, one outer link is omitted from the given location between two inner links and this ensures the separation of the chain which is produced.

The continuous operation of the machines and the continuous kinematic arrangement, which governs the various manufacturing operations, enable very precise control of the whole manufacturing procedure to be accomplished.

A preferred embodiment of the invention will now be described in greater detail, by way of example, with reference to the accompanying drawings, in which:

FIGS. 1A, 1B are, respectively, a view from above and a view in longitudinal section of an inner or outer link plate according to the invention;

FIG. 2 is an exploded sectional view of the various components of an inner link;

FIG. 3 is a sectional view of an assembled inner link;

FIG. 4 is a sectional view of the first assembly stage of an outer link;

FIG. 5 is a sectional view showing an outer link blank and two inner links arranged so as to be fitted on to the outer link;

Figure 6:
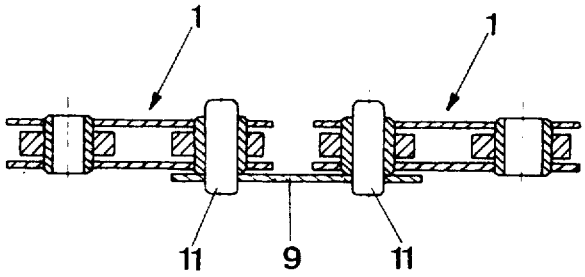
Figure 7:
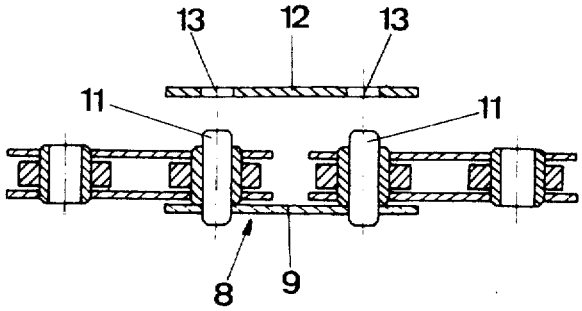
Figure 8:
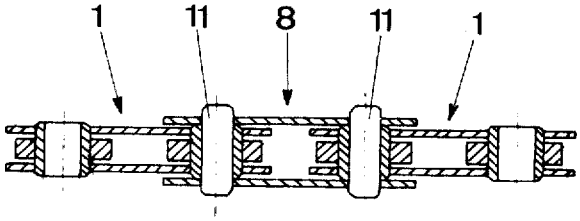
Figure 9:
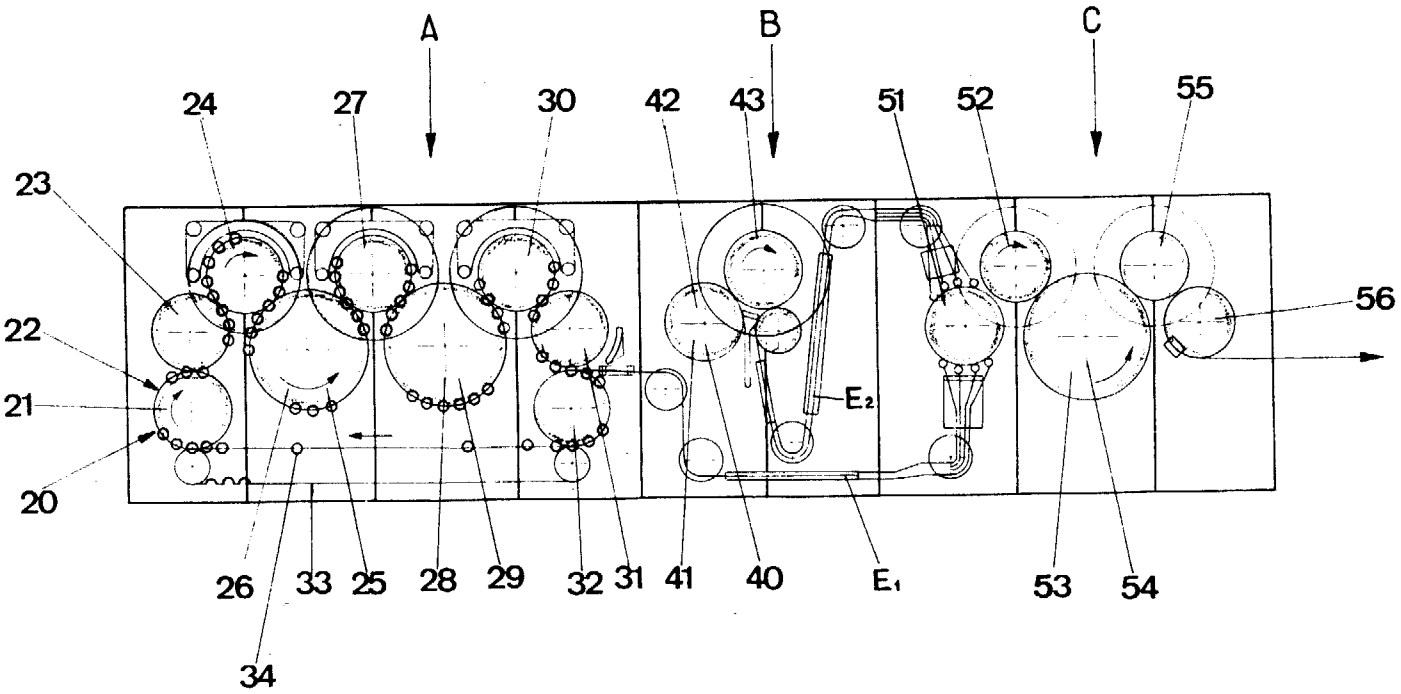
Figure 48:
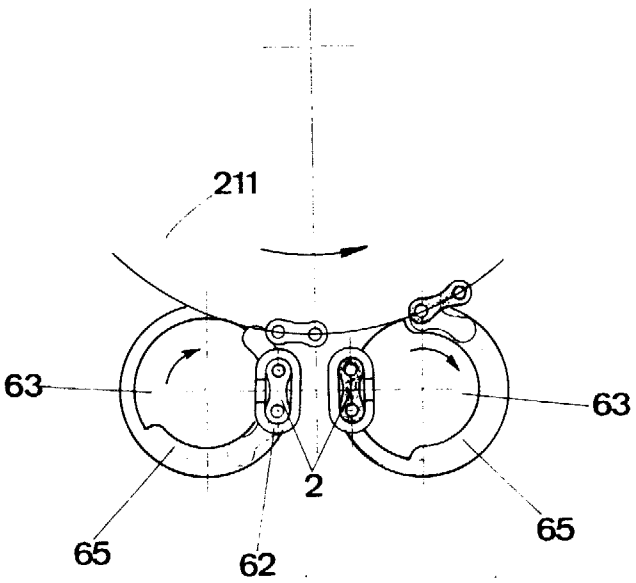
Figure 47:
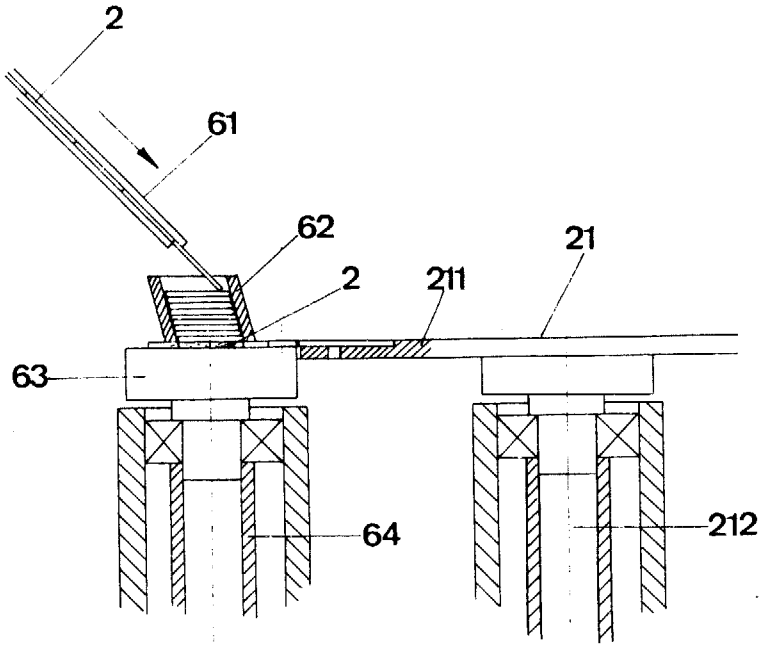
Figure 49:
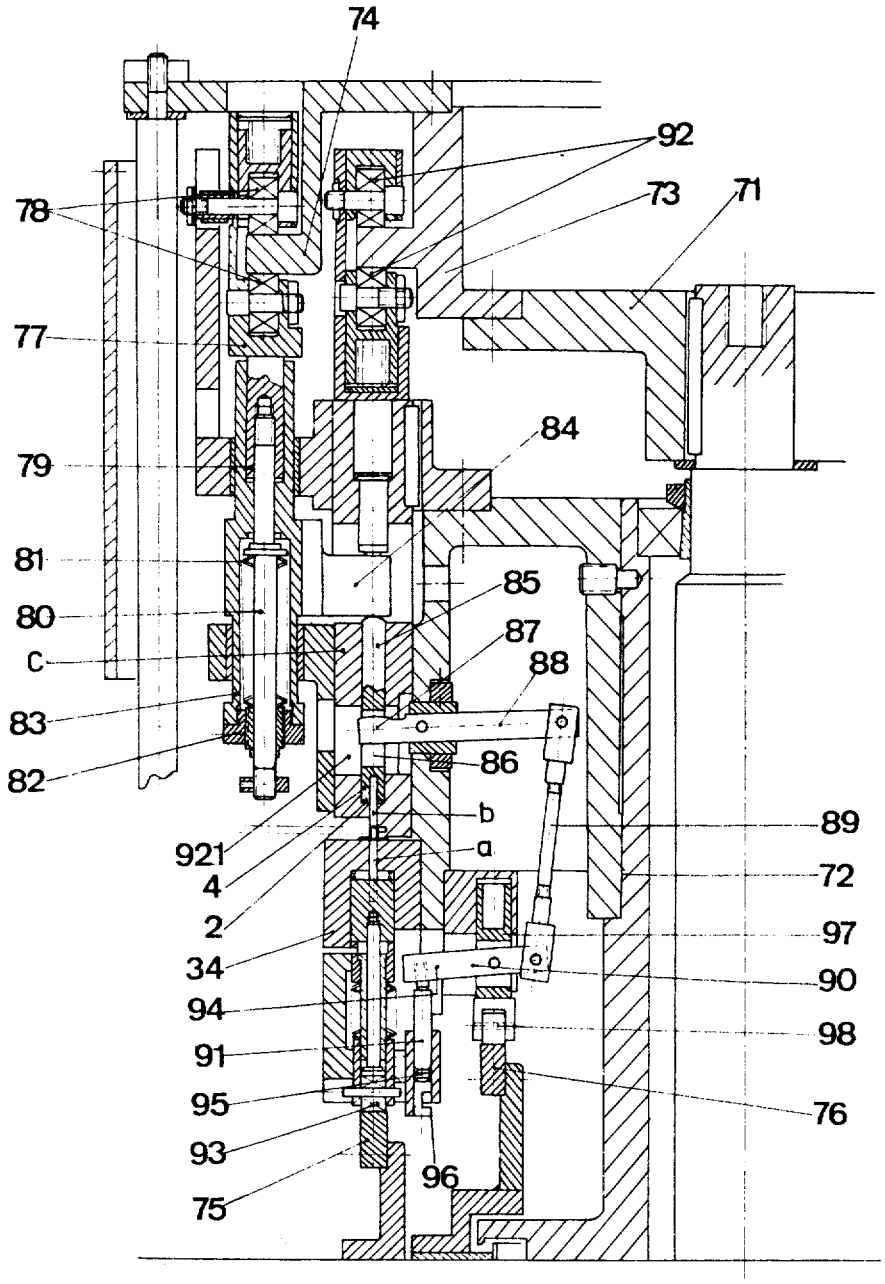
Figure 50:
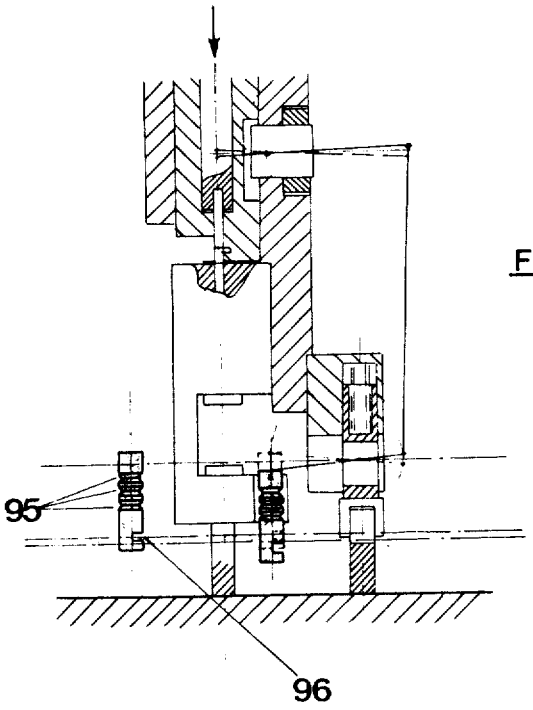
Figure 52:
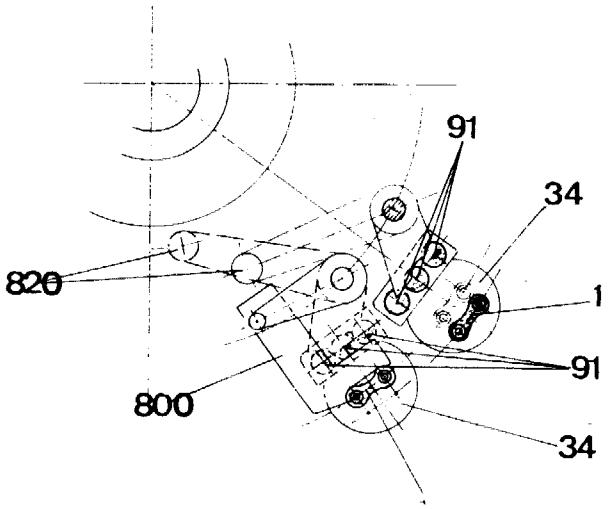
Figure 51:
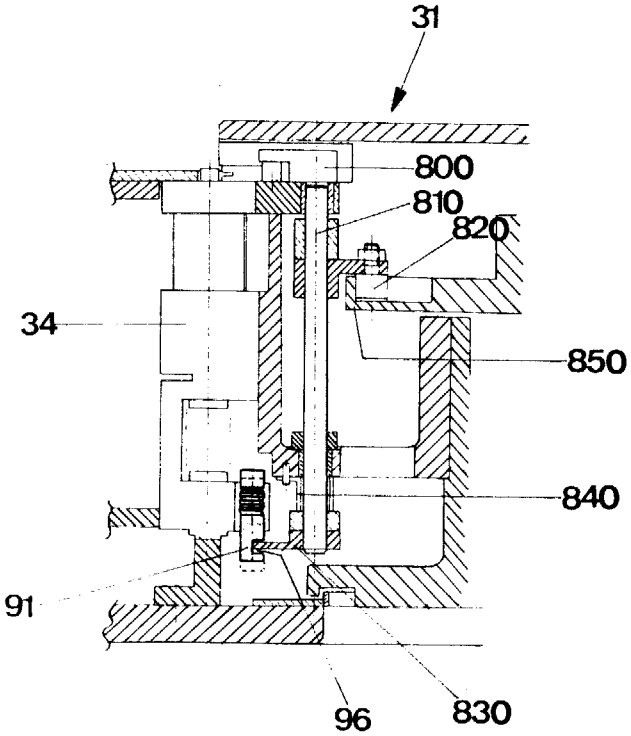

FIG. 6 corresponds to FIG. 5, the inner links being fitted;

FIG. 7 illustrates the placing into position of the upper plate of the outer link;

FIG. 8 illustrates the assembly obtained by two inner links connected by an outer link;

FIG. 9 is a diagrammatic plan view of a plant for the manufacture of link-chains;

FIGS. 10 to 46 illustrate in detail the various operational stages on the working cylinders of the machines A, B, C;

FIG. 47 is a sectional view of a cylinder for receiving the lower plates;

FIG. 48 is a simplified view from above corresponding to FIG. 47;

FIG. 49 is an axial vertical section of a working cylinder taken along the axis of the tools of a work station;

FIG. 50 illustrates various possible positions of a memory sensor;

FIG. 51 illustrates the device for detecting the position of the memory sensor at the level of the sorting cylinder, this view being a simplified vertical section;

FIG. 52 is a diagrammatic view from above corresponding to FIG. 51.

The chain which it is proposed to produce (FIG. 8) in accordance with the method of the invention is composed of inner links 1 joined by outer links 8. In the following there will be described an inner link and then an outer link and, finally, the assembly of the two types of links.

As shown in FIGS. 1 to 3, each inner link 1 comprises a lower plate 2 provided with two holes 3. This plate has an external configuration substantially in the shape of an '8'. Bushes 4 are secured with a force-fit in the holes 3 of the lower plate 2 (FIG. 2). Freely rotatable rollers 5 are slid on to the bushes 4 and, finally, an upper plate 6, identical to the lower plate 2 (FIG. 1), is provided, and is force-fitted on to the bushes 4. There is thus produced the inner link 1, illustrated in FIG. 3.

The bushes 4, of circular cylindrical shape, have a length which is slightly greater than the thickness of the inner link 1. However, the length of the rollers 5, which are of circular cylindrical shape, is slightly less that the clearance defined by the lower plate 2 and upper plate 6, after their assembly on the bushes 4.

According to FIG. 4, the assembly of an outer link 8 is effected starting from a lower plate 9 whose structure is substantially the same as that of the lower plate 2 of the inner link 1 (FIG. 1). This lower plate 9 comprises two cylindrical holes 10 each receiving by force-fit a pin 11. When this outer link blank is produced (FIG. 5) then two inner links 1 are positioned coaxially with the fitted pins 11 so as to align the bushes 4 with a corresponding pin 11. Subsequently the bushes 4 are fitted on the pins 11 (FIG. 6). Following this (FIG. 7) the upper plate 12 of the outer link 8 is placed in position. This upper plate 12 is identical to the lower plate 9. It comprises two holes 13 intended to receive by force-fit the corresponding end of each fitted pin 11. After the upper plate 12 has been fixed in position, the assembly represented in FIG. 8 is obtained.

The complete construction of a chain in accordance with the invention necessitates the successive connection of inner links and outer links, as will be described in detail with reference to FIGS. 9 to 46.

FIG. 9 illustrates diagrammatically a plant for the continuous production of the chains described above (FIGS. 1 to 8).

According to FIG. 9, the plant comprises a machine A for the manufacture of inner links 1, a machine B for the manufacture of blanks of outer links 8, and a machine C ensuring the assembly of inner links 1 and of blanks of outer links 8 so as to continuously form the link-chain. The machine A is joined to the assembling machine C by a transfer means $E_1$ and the machine B is joined to the machine C by a transfer means $E_2$.

The machine A continuously produces inner links 1 while simultaneously the machine B produces the blanks of outer links 8, at the same rate.

The machine A, for manufacturing the inner link 1, comprises nine cylinders 21, 23, 24, 25, 27, 29, 30, 31, 32. In cavities in these cylinders, there are conveyed "vehicles" 34 forming a continuous procession. Between the cylinders 32 and 21 the "vehicles" are transferred in a straight line by a conveyor 33 which is not illustrated in detail. Thus the "vehicles" travel over a closed circuit through the machine. The purpose of these "vehicles" is to act as containers for conveying parts or sets of parts to be processed, as will be described below.

In greater detail, the machine A for manufacturing the inner link 1 comprises a distributing device 20 for lower plates 2, which supplies these lower plates 2 to the cavities of a receiving cylinder 21, which likewise receives rollers 5 from a distributing device 22 at a different level to the lower plates. The cylinder 21 transfers the lower plates 2 and the rollers to a grouping cylinder 23 for the plates 2 and rollers 5.

The assemblies, formed by the lower plates 2 and two rollers 5, are brought on to the grouping cylinder 23, which forwards them on to the work cylinder 24, where the lower plate 2 and the two rollers 5 are firstly centred in relation to one another and then positioned on the vehicle 34.

A distributing device 26 for bushes supplies bushes 4 to the transfer and grouping cylinder 25. These bushes 4 are then transferred on to the work cylinder 27 so as to be fitted there in the rollers 5, which are already in position, and in the lower plates 2 of the various inner links 1 in the course of manufacture. The assemblies thus formed pass round the receiving cylinder 29 for the upper plates 6.

A distributing device 28 for upper plates 6 supplies upper plates 6 to the cylinder 29. At this point the upper plates 6 are positioned in relation to the blanks of the inner links 1.

The upper plates 6 are firmly attached to the bushes 4 on an assembly cylinder 30, which forwards them into a sorting cylinder 31. At this point there takes place checking of dimensions and, more generally, of the structure of the inner links 1 produced in the preceding cylinders. Any defective links are rejected and the inner links 1 which are up to standard pass over the transfer means $E_1$, which forwards them toward the machine C for assembling the chain.

To sum up, the machine A, such as described above for manufacturing inner links 1, carries out the operations which will be described in detail with reference to FIGS. 10 to 24.

All the operations, both for transfer and for assembly which take place in the machine A, are carried out in a continuous kinematic arrangement. This means that the various parts, after having entered the machine A, circulate without variation in velocity between the different cylinders from the receiving cylinder 21 up to the sorting cylinder 31. This means that the parts or assemblies do not change velocity and do not stop at any time, all the operations of assembly and transfer being effected while in motion.

In view of the small size of the parts and assemblies it is particularly advantageous to place them in "vehicles" 34, thus facilitating the positioning or interchange of parts between the different cylinders.

Generally speaking, the interchange of one part or of a set of assembled parts between one cylinder and the cylinder immediately following in the direction of assembly is effected at the point of geometrical contact of the two cylinders, the part or vehicle carrying the latter being released from the first cylinder to be taken in charge by the second.

The machine B for manufacturing blanks of outer links 8, which as illustrated in FIG. 9, is located to the right of the machine A, comprises a device 40 for distributing lower plates, which supplies lower plates 9 to a receiving cylinder 42. At the same time a pin-distributing device 41 supplies pins 11 to this receiving and grouping cylinder 42. The distributing device 41 delivers on each occasion two pins 11 for one lower plate 9. The grouping cylinder 42 positions the pins 11 in relation to the holes 10 of the lower plate 9 (FIG. 5). The blanks of outer links are fitted, i.e., the pins 11 are inserted by force into the holes on a work cylinder 43, at the outlet from which they are taken up once more by the transfer means $E_2$, which conveys them towards the chain-assembling machine C.

The chain-assembling machine C comprises an admission cylinder 51 connected with the two transfer means $E_1$ and $E_2$ conveying the inner links 1 and the blanks 9, 11 of the outer links 8, respectively. The admission cylinder 51 supplies the components which it receives to a transfer cylinder 52, which conveys them on to a grouping cylinder 54. A distributing device 53 for upper plates supplies the plates 12 to the grouping cylinder 54.

In the grouping cylinder there is effected the assembly of lower links on the blanks of outer links, then the placing in position of the upper plate 12 of each outer link 8. The chain which is assembled at this instant, passes over a transfer cylinder 55 and over a marking cylinder 56.

In the following there will be described the details of the operations for manufacturing chains, with reference to FIGS. 10 to 46.

With the aim of simplifying this description, in FIGS. 10 to 46 the drawing has been limited to a sectional view of a work station of each cylinder and, in each case, there is only illustrated a single set of members and a single set of fitted pins, bushes and rollers.

In fact, since the inner links 1 have two bushes 4 and two rollers 5, it is clear that it is necessary to duplicate the corresponding members which support and locate the components.

The same observation applies to the outer link 8 which is composed of two fitted pins 11 inserted in the lower plate 9 and the upper plate 12.

Furthermore, it should be pointed out that each work or transfer cylinder comprises on its periphery a certain number of recesses termed "cavities" accommodating the parts being machined The description, given below with reference to FIGS. 10 to 46, relates in each case to a single recess for parts, again designated "cavity."

The fitting of the blank of outer links 8, which are formed by the lower plate 9 and pins 11, will be described as will the members of the corresponding cylinders, with reference to FIGS. 25 to 32.

Finally, the assembly of the chain will be described, that is to say the joining of the inner links 1 to the blanks of the outer links 9, 11 and the final assembly of the outer links, by way of FIGS. 33 to 46.

To simplify the description of the members which are necessary for the various operations, the same reference numerals are used for all the equivalent members of the various cylinders.

The fitting of the inner link, which is effected on machine A, starts with the forwarding on to the cylinder 21 of the lower plate 2 conveyed on the vehicle 34, itself already positioned by an inner punch *a* which is retracted in relation to the vehicle. An upper punch *b* is likewise retracted (FIG. 10) in relation to the vehicle, it being situated above this latter.

Subsequently, still on the cylinder 21, a roller is superposed on the lower plate 2. At the time of this placing in position, the upper and lower punches *a*, *b* are still in the retracted position (FIG. 11), the plate and the roller being precentred by their outer contours.

During the following stage on the cylinder 23 (FIG. 12), the upper punch *b* descends and penetrates into the bore of the roller 5 and of the plate 2 so as to centre the roller 5 in relation to the plate. At the same time an outer punch *c* is put into position so as to retain the lower plate by an indent $c_1$ in punch *c*. The roller 5 is itself retained by a shoulder *d* of the cylinder 23.

Then the unit, composed of the lower plate 2 provided with the roller 5 and positioned on the vehicle 34, is transferred to the work cylinder 24. On this cylinder the lower punch *a* ascends into the inside of the hole 3 of the plate 2, this latter being prevented from undergoing any upward movement by the outer punch *c*. During this movement the upper punch *b* remains retracted (FIG. 13).

Figures 10, 11, 12, 13, 14:
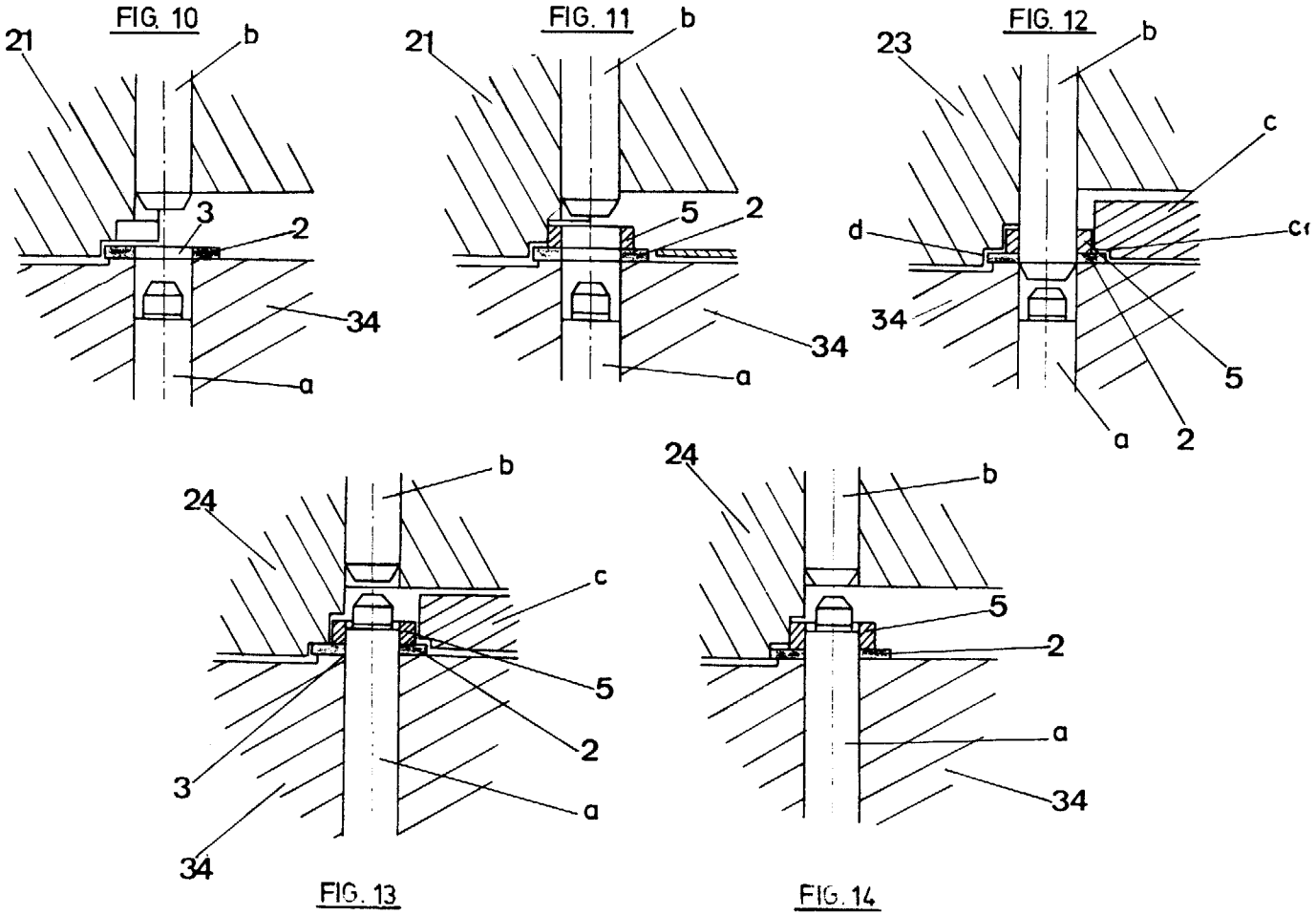

When the punch *a* is inserted into the hole 3 and the bore of the roller 5, the outer punch *c* is removed (FIG. 14).

Starting from this moment the placing in position of the lower plate 2 and of the rollers 5 takes place and it is possible to put the bushes of this inner link into position.

Figure 15:
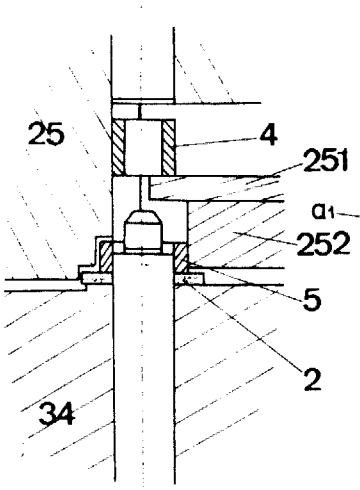
Figure 27:
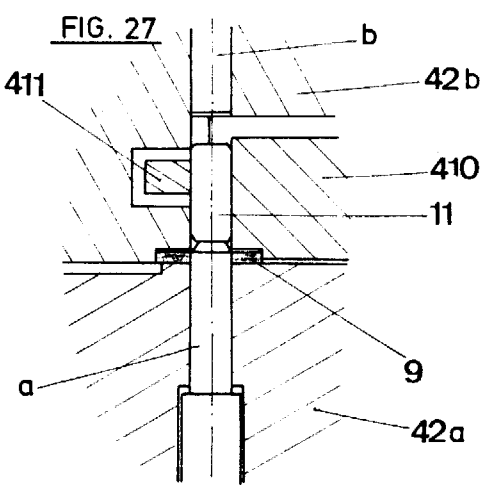
Figure 26:
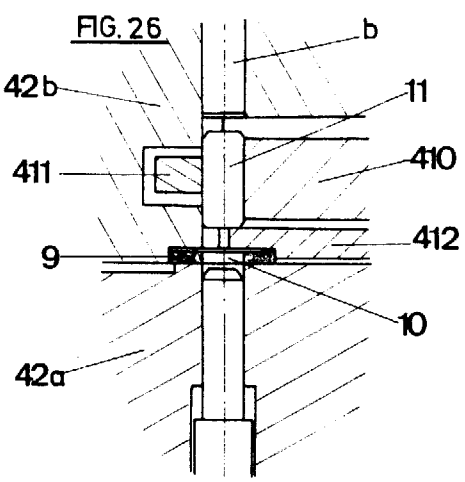
Figure 25:
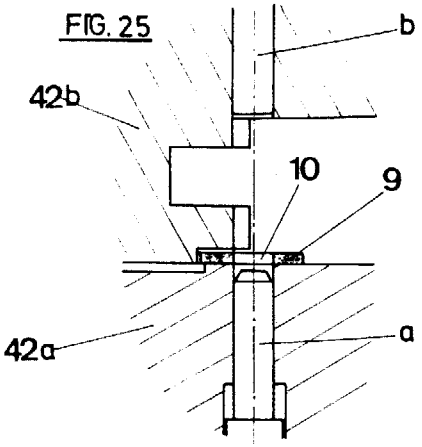

In FIG. 15, the vehicle 34 carrying the plate 2 and the two rollers 5 passes over to the cylinder 25, at which the bushes 4 are received. A bush slides along a ramp 251 and the rollers 5 are retained by a guard member 252.

Figure 16:
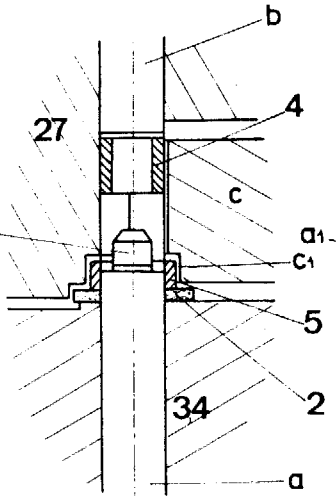

After this placing in position of the bush 4, the assembly thus formed passes over to the work cylinder 27. This cylinder comprises an outer punch *c*, whose indent $c_1$ serves to secure the rollers 5 on the lower plate 2 during the placing in position of the bushes 4 (FIG. 16).

Figure 17:
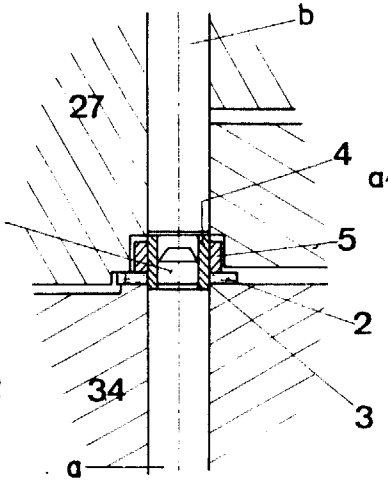

Through a combined movement, retracting the lower punch *a* and descending the upper punch *b*, firstly, the bush 4 is placed on the head $a_1$ of the lower punch *a* and then the simultaneous descent of the two punches *a*, *b* ensures the positioning by force-fit of the bushes into the corresponding holes 3 of the lower plate 2 (FIG. 17).

Figure 18:
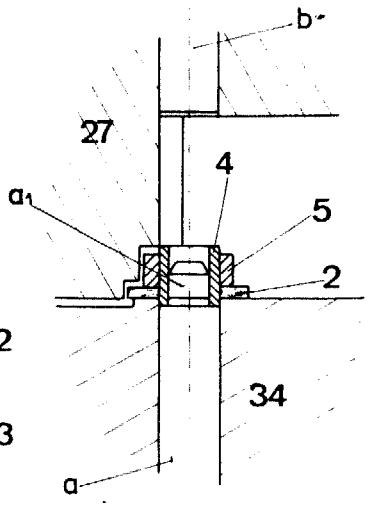

During the continuation of the movement over the same cylinder 27, the upper punch *b* passes into the retracted position, the lower punch *a* remaining with its head $a_1$ engaged in the corresponding bore of the bush 4 (FIG. 18).

Next, the upper plate is put into position so as to complete the formation of the inner link 1.

According to FIG. 19, the blank of the inner link 2, 4, 5, carried by the platform 34, arrives in the cylinder 29. The lower punch *a* of the cylinder is secured in the bore of the bush 4. Simultaneously an upper plate 6 is brought on to a ramp 291 (FIG. 19).

During the succeeding stage, during the rotation of above-described assembly, the upper punch *b* of the cylinder 29 penetrates into the corresponding aperture 13 in the upper plate 6 so as to centre this plate in relation to the axis of the bore of the corresponding bush 4. Since the ramp 291 has an open slot, which follows up to its end the path of the punch *b* of the cylinder 29, the punch *b* is made to descend so as to bring it into contact with the head $a_1$ of the punch *a* (FIG. 21) while still remaining on the cylinder 29. Then, after the removal of the ramp 291, there is lowered an outer punch 292 surrounding the upper punch *b* so as to lower the upper plate 6 and fit it on to the upper part of the corresponding bush 4 (FIG. 22).

When this fixing in position has been accomplished, the outer punch 292 and also the upper inner punch *b* are withdrawn freeing the inner link thus formed. An outer punch 293 then co-operates with the inner link by penetrating with its front edge into the corresponding part of the recess defined between the lower plate 2, the upper plate 6 and the rollers 5 (FIG. 23), as the outer punch 292 is withdrawn.

At the same time as the withdrawal of the upper punch 292 is proceeding, there is automatically placed in position a second outer punch 294, positioned similarly to the punch 293 but inside the path followed by the inner link 1. The placing in position of this punch 294 is effected at the same time as the withdrawal of the lower punch *a*.

The two members 293, 294 form ramps taking charge of the inner link 1 so as to release it from the vehicle 34, this latter returning to the inlet of the machine A, whereas the inner link 1 is forwarded toward the admission cylinder 51 of the chain-assembling machine C.

Concurrently with the above-described operations the blank of the outer links is produced on the machine

B.

During a first stage (FIG. 25) the lower plate 9 is brought on to the grouping cylinder 42, comprising two parts 42*a*, 42*b*. During this placing in position, upper punch *b* and lower punch *a* of the cylinder 42 are retracted.

During a second stage (FIG. 26), on the same cylinder 42, the pins 11 are brought coaxially to the apertures 10 of the lower plate 9. These pins are brought in a vertical position between the ramps 410, 411 of the pin-distributing device 41 (FIG. 9), a guard member 412 retaining the plate 9.

During the continuation of the movement of the cylinder 42 (FIG. 27) the lower punch *a* ascends and passes through the plate 9. At the same time (FIG. 28) the upper punch *b* descends and is applied against the pin 11, which is then held between the punches *a* and *b* (FIG. 28).

Figure 28:
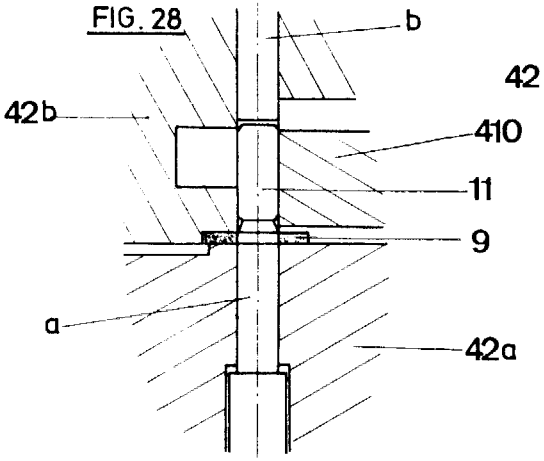

The assembly formed by the lower plate and the pins is then transferred on to the cylinder 43, the relative positions of the plate, the pins and the members of the cylinder 43 being identical to those which have just been described for the cylinder 42 (FIG. 28).

The cylinder 43 continues its movement and the assembly formed by the lower punch *a*, the pin 11 and the upper punch *b*, descends in such a way as to fit the pin 11 into the corresponding hole 10 of the lower plate 9 (FIG. 29), the lower punch *a* serving as an abutment for the pin 11.

Figure 30:
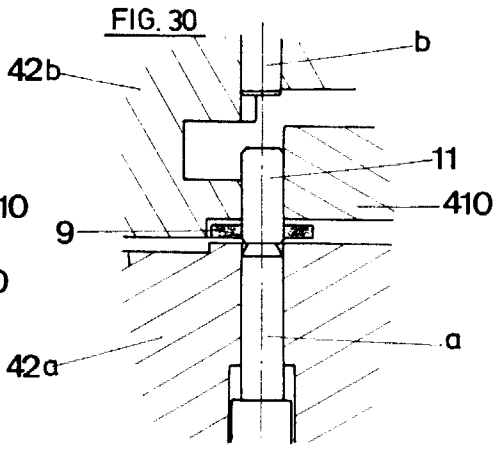
Figure 29:
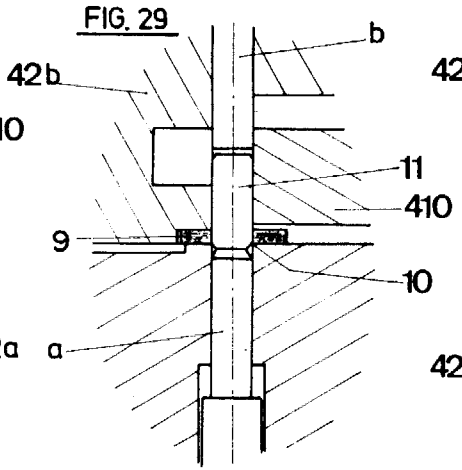

After this insertion the upper piston *b* is withdrawn and the lower piston ascends slightly so as to raise the blank 9, 11 thus formed (FIG. 30).

Figure 32:
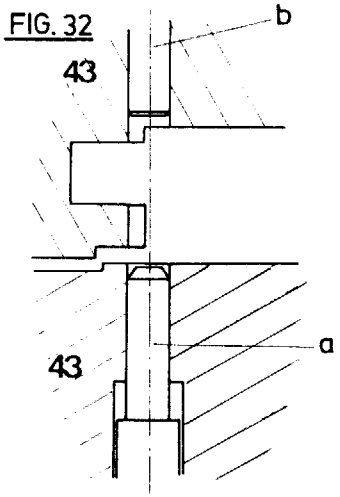

This blank 9, 11 is taken in charge by a set of guard members 431, 432 and a ramp 433 so as to pass on to the chain-assembling machine C (FIG. 31), The cylinder 43 is then free, as shown in FIG. 32.

Figure 33:
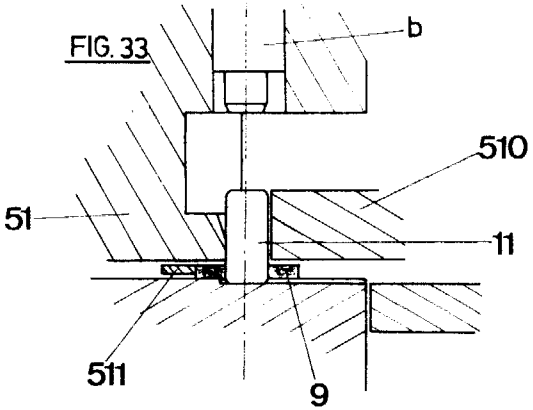

In the assembling machine C, during a first stage, the blank, 11, 9 is put in position on the admission cylinder 51 by means of ramps 511, 510; the blanks 11, 9 are conveyed by the transfer means $E_2$ of the machine B (FIG. 33).

Concurrently with this placing in position, on the same cylinder 51, the inner links 1 are positioned coaxially in relation to the inserted pins 11 (FIG. 34) by means of the guiding and distributing member 511. These links 1 proceed from the machine A by way of the conveying means $E_1$.

Figure 36:
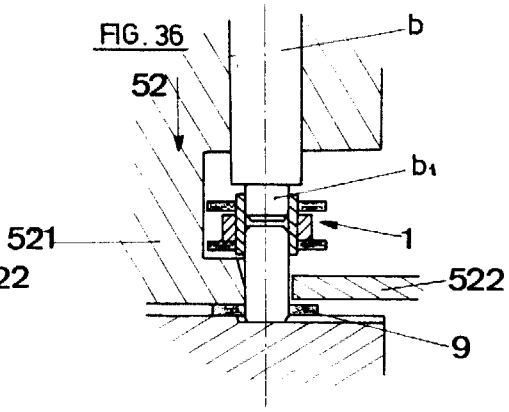
Figure 35:
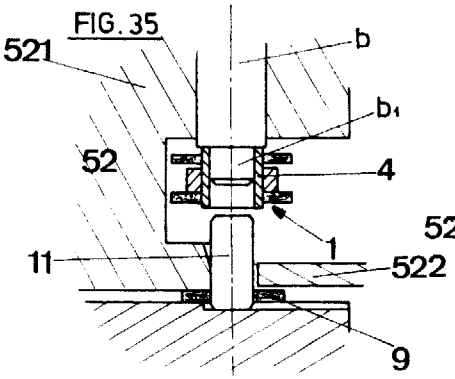
Figure 31:
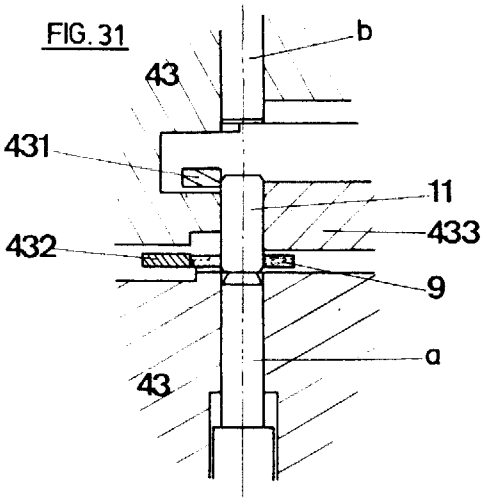
Figure 34:
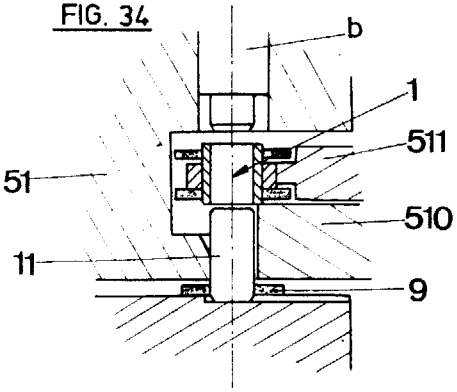

The assembly formed by the blanks 11, 9 and the inner links 1 is then transferred on to the cylinder 52 (FIG. 35). The upper punch *b* then descends so that its head $b_1$ engages in the bore of the bush 4 of the corresponding inner link 1 (FIG. 35). During the rotational movement of the cylinder 52 the outer punch 521 is lowered so as to hold tight the lower plate 9 during the insertion of the upper punch *b* for the placing into position of the intermediate link, 1, the blank 9, 11 being retained by a ramp 522 (FIG. 36).

The upper punch *b* merely places in position the intermediate link 1 on the corresponding pin 11, however, without introducing it completely. A guide ramp 524, coming between the lower part 523 of the cylinder 52 and the movable punch 521 of the cylinder 52, releases the assembly thus partly fitted (FIG. 37), and this frees the cylinder 52 (FIG. 38).

The assembly is then forwarded on to the grouping cylinder 54 for the placing in position of the upper plate 12.

Figures 37, 38, 39, 40, 41, 42:
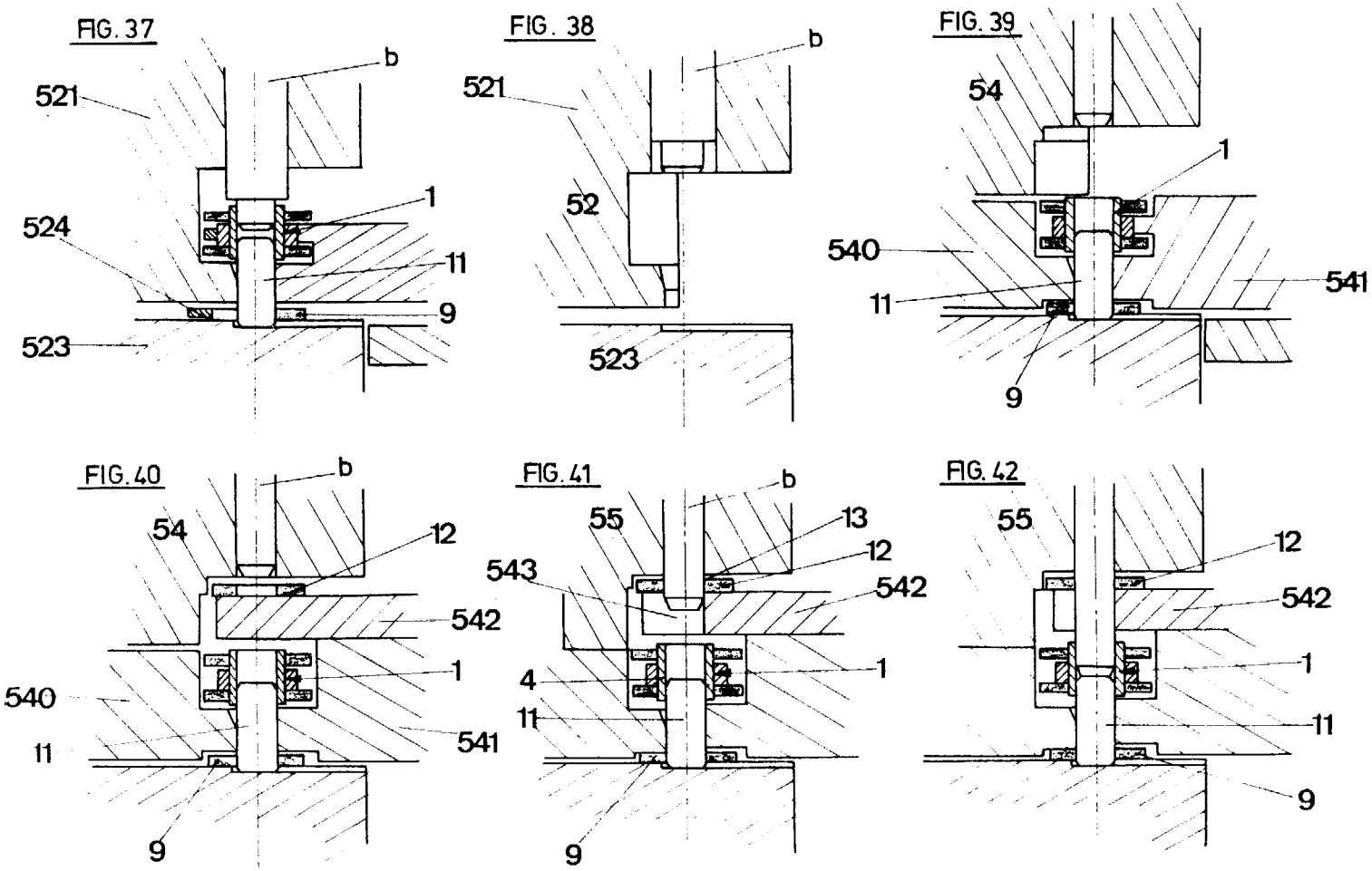

In more detail, firstly the assembly 9, 11, 1 is positioned in relation to the intermediate part 540 of the cylinder 54, thus making it co-operate with an outer ramp 541 (FIG. 39).

During the continuation of the movement of the cylinder 54, the assembly 9, 11, 1 passes beneath a ramp 542 which conveys the upper plate 12 (FIG. 40.)

The assembly 9, 11, 1, 12 is then transferred on to the cylinder 55 (FIG. 41).

According to FIG. 41, the ramp 542 terminates in a fork bounding a slot 543 which is open and arranged following the path of the upper punch *b*. This latter can then be positioned in the aperture 13 in the upper plate 12, can penetrate into the slot 543 and can be inserted into the bore of the bush 4 of the intermediate link 1 (FIGS. 41 and 42).

Figure 44:
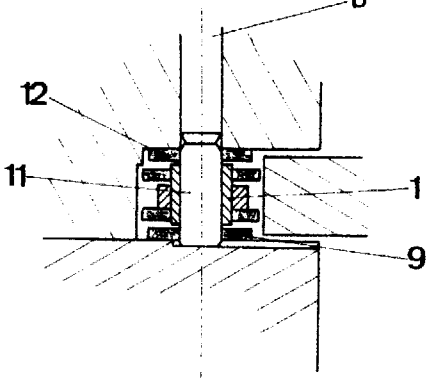
Figure 43:
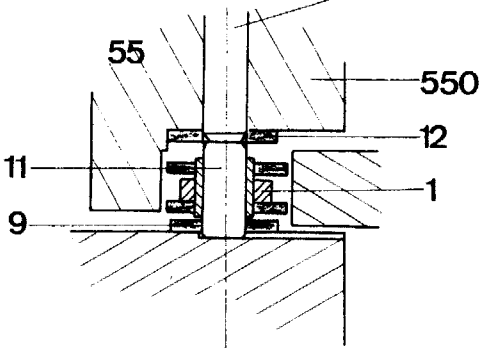

The ramp 542 supporting the upper plate 12 then retracts, the outer punch 550 of the cylinder 55 thus being able to lower the upper plate 12 along the punch *b* so as to firmly attach this plate 12 to the corresponding end of the pin 11 (FIGS. 43 and 44).

Figure 46:
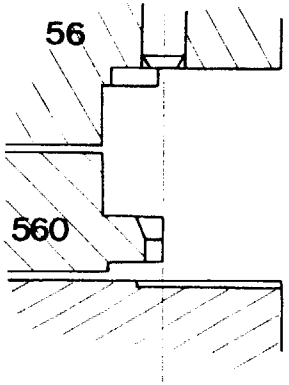
Figure 45:
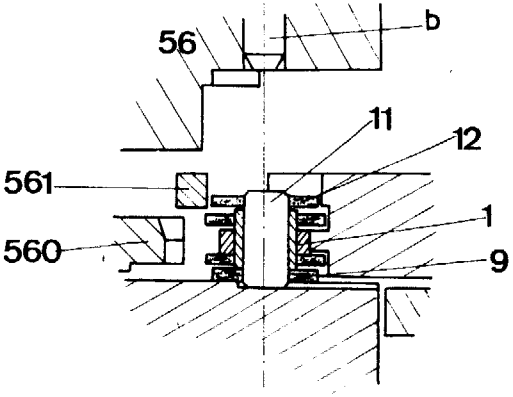

The chain assembly thus completed is caused to pass on to the cylinder 56 for the accomplishment of the marking of the chain by means of the member 560. This cylinder likewise has a removal ramp 561 enabling the chain to be taken away (FIGS. 45 and 46).

In one embodiment of a means for the distribution of plate components, such as the plates 2, 6 of the inner link 1 or plate 9, 12 of the outer link 8, there is advantageously used a distributer illustrated partly in FIGS. 47 and 48.

According to FIG. 47, the distributing device comprises a supply store such as a vibrating bowl (not shown) which forwards, for example, the plates 2 into a slideway 61, in which the parts 2 are one behind the other, preferably in longitudinal direction, so that they can only occupy one position during their transfer.

The lower end of the slide 61 discharges into an inclined cylindrical container 62 shaped in accordance with the outer contour of the parts 2. This cylindrical container 62, which is open at its upper end so as to receive the parts 2, is likewise open at its lower end where it discharges on to a drum 63. This drum, described with reference to FIG. 48, comprises on its upper surface recesses which can receive in each case the lower plate 2, located at the bottom of the stack contained in the cylindrical container 62, so as to remove it from this stack and forward it by rotation on to a platform 211 of the cylinder 21, for example. The drum 63 and the platform 211 are rotationally mounted on pivots 64, 212 respectively. These mountings are not described in detail.

FIG. 48 shows in plan the shape of the drum 63 and the transfer of the plates between the drum 63 and the platform 211.

According to FIG. 48, the drum 63 has over a portion of its periphery a cutaway zone 65, the width of which corresponds approximately to half the mean width of one plate 2. This cutaway portion in vertical direction corresponds to the height of a plate 2 and extends over a fraction of the periphery of the drum 63. The cylindrical container 62 is arranged in relation to this portion 65 in such a way as to permit the removal of the plates 2. When the drum 63 rotates about its vertical axis it removes in each case one plate 2 and forwards it on to the platform 211.

In FIG. 48 there are illustrated two distribution means interacting with the platform 211. Each distribution means only supplies with plates one cavity out of every two on the platform 211. The angular setting of the cutaway portions 65 of the two drums 63 is such that this transfer may be effected correctly.

The following is a general description of one work station for one cylinder, using where requisite the same general reference numerals as used for the corresponding members in the description of FIGS. 10 to 46.

According to FIG. 49, the cylinder comprises a fixed portion 71 and a movable portion 72 rotating about the axis of the fixed portion 71.

The fixed portion 71 carries a peripheral cam 73 assigned to the outer punches and a cam 74 enabling the fitting pressure to be exerted.

A lower fixed cam 75 co-operates with the lower punches and a cam 76, also lower, ensures the control of memory sensors 91.

The cylinder illustrated in FIG. 49 is, for example, the cylinder ensuring the insertion of the bushes 4 into the holes 3 of the lower plate 2 of an inner link in the course of manufacture.

The movable portion 72 of the cylinder carries a ram 77 whose two rollers 78 co-operate with the two faces of the cam 74. This ram 77 is connected at its lower end 79 to a rod 80 on which there are fitted Belleville springs 81, the lower end of the column of Belleville springs 81 bearing against the lower part 82 of the vertically movable guide 83. The guide 83 carries an arm 84 which acts on a control member 85 bearing the upper punch *b*. The control member 85 has an oblong hole 86 accommodating the end 87 of the detector arm 88 of the control system for the punches. This arm 88 is connected by a connecting rod 89 to a lower arm 90 which acts with its end on the sensor 91, so as to insert it when required, as will be described later.

In view of the mode of articulation of the arms 88, 90 and their connection by the connecting rod 89, any movement of the end 87 results in a movement in the same direction by the end 93 of the arm 90.

The outer punch *c* is controlled by the fixed cam 73 acting on the rollers 92. This outer punch *c* likewise comprises an aperture 921 for the passage of the front end 87 of the arm 88.

The lower punch *a*, which passes through the vehicle 34, is actuated by the fixed cam 75 by means of the roller 93.

Any penetrating movement of the inner punch *b* or of the outer punch *c* or of both at the same time results, in such a case, in actuation of the end 87 which displaces the end 94 of the arm 90.

This end 94 then inserts the sensor 91 which is received in a cylindrical seating with vertical axis and rigidly connected with the movable portion 72 of the cylinder.

The sensor 91 is held in position by means of its peripheral grooves 95, into which retaining balls (not shown) engage (FIG. 50).

The lower end of the sensor 91 comprises a slot 96, the level of which constitutes the memory of the sensor 91.

This memory sensor may serve for recording the descending movement of the upper punches into or on to the components to be processed.

The ram 77 which, bearing on the cam 74, exerts a force in the downward direction during the rotation of the cylinder, transmits this force to the Bellville springs 81 forming a calibrated resilient mechanism. Since the force exerted by the ram 77 is greater that the calibrated force of the springs 81, the column of springs 81 undergoes compression.

In this case the arm 84 is no longer forced downwards with the result that the end 87 of the arm 88 does not force the sensor 91 downwards.

The pivot pin of the arm 90 is carried by a movable device 97 provided with a roller 98 rolling along the cam 76. This control system enables the pivot point of the arm 90 to move in relation to that of the arm 88 so as to control the actuating position of the end 94 of the arm 90 in dependence on the cylinder and to add or subtract elements in the memory.

FIG. 50 illustrates various possible positions of the memory sensor. In accordance with the insertion of the upper punch, the sensor is inserted, or is not inserted, by one length, which is determined by reading the level of the slot 96.

The sectional view of FIG. 51, for example at the level of the sorting cylinder 31, shows an ejector 800 rigidly attached to a vertical spindle 810 and carrying a guide roller 820. The lower end of the spindle 810 carries a detector lug 830 which detects the position of the slot 96 of the sensor 91. A return spring 840 restores the spindle 810 into its initial position by applying the roller 820 against the cam 850. However, if the detector lug 830 is unable to penetrate into the slot 96 of the sensor 91, as a result of an excessively large penetration of the sensor 91, then the ejector 800 allows the faulty part to remain on the vehicle 34.

FIG. 52 clearly shows these two solutions. According to this Figure, each checked part is associated with three sensors 91 and the detector lug 830 simultaneously detects the three combined sensors 91.

If the sensors 91 occupy the correct position, indicating that the part (for example the inner link 1) has been correctly made and meets the prescribed standards, the ejector 800 may pivot by rotation of the spindle 810, the roller 820 then following the cam 850.

The part 1 passes over the prescribed path. It is a case here of the position illustrated to the right in FIG. 52.

However, if the detector lug 830 cannot be accommodated in the slots 96, it prevents the roller 820 from following its cam path and from causing the ejector member 840 to pivot, member 800 then cannot eject the part 1 from the vehicle 34 carrying it, with the result that the part remains on this vehicle and is discarded as a reject.

Naturally the invention is not restricted to the example of embodiment described and illustrated above, on the basis of which it would be possible to provide other forms and modes of embodiment, without thereby departing from the scope of the invention.

I claim:

1. Apparatus for the continuous production of chains comprising a first machine composed of a plurality of cooperating cylinders having at least one work station around the periphery of each cylinder capable of performing a step in the manufacture of inner links, a second machine composed of a plurality of cooperating cylinders having at least one work station around the periphery of each cylinder capable of performing a step in the manufacture of outer link blanks, a third machine composed of a plurality of cooperating cylinders having at least one work station around the periphery of each cylinder capable of performing a step in completing the manufacture of outer links from said outer link blanks after joining said outer link blanks to said inner links to form a chain, first transfer means for transferring said inner links from said first machine to said third machine, and second transfer means for transferring said outer link blanks from said second machine to said third machine, all of said machines and transfer means operating in a constant, continuous manner.

2. Apparatus as claimed in claim 1, wherein said first machine for the manufacture of inner links comprises a first device for distributing first lower plates and forwarding these plates to a first receiving cylinder, a roller-distributing device which distributes the rollers on the first lower plates already located on the first receiving cylinder, means for forwarding said plates and rollers to a first grouping cylinder, means for passing said plates and rollers on to a first work cylinder for ensuring the centering of each lower plate with two of the rollers, a bush-distributing device supplying bushes to a second grouping cylinder, means for passing said plates, rollers and bushes to a second work cylinder where the bushes are engaged in the rollers and into the lower plates of the inner links, means for transferring blanks thus joined to a second receiving cylinder which receives the upper plates from a second plate distributing device, and means for forwarding the inner links thus formed from said second receiving cylinder to a sorting cylinder.

3. Apparatus as claimed in claim 2 characterized in that elements constituting the inner links are fed in a continuous kinematic arrangement into said first machine for assembling the inner links, the links being formed on vehicles circulating in a closed circuit, the vehicles being taken in charge by said first receiving cylinder at the inlet to the assembly path and being separated from the completed inner links at the outlet by a return cylinder arranged following the sorting cylinder.

4. Apparatus as claimed in claim 1 wherein said second machine for assembling the blanks of outer links comprises a receiving cylinder for receiving simultaneously pins supplied by a first distributing device and outer lower plates supplied by a second distributing device, means for forwarding the said pins and outer lower plates to a work cylinder for assembling said outer lower plates and said pins, and means for delivering the blanks of outer links to said second transfer means for forwarding the blanks to said third machine.

5. Apparatus as claimed in claim 1 wherein said third machine comprises an admission cylinder joined to said first transfer means for forwarding the inner links and joined to said second transfer means for forwarding the blanks of the outer links, said admission cylinder having means for forwarding the components to a first transfer cylinder for interchanging the components to a grouping cylinder, said grouping cylinder having means for ensuring the assembly of the inner links with the blanks of outer links and means for receiving the outer upper plates supplied by a distributing device for completion of assembly, and means for passing the assemblies thus formed on to a marking cylinder by way of a second transfer cylinder.

6. Apparatus as claimed in claim 1 wherein each machine includes at least one distributing device for distributing link plates, said distributing device comprising a supply store, a slideway for distributing the plates one after the other so that the plates can only occupy a single position during their transfer, said slideway having an upper end communicating with said store and a lower end discharging into a cylindrical container to form a stack of said plates, said container discharging onto a cylindrical drum, said drum having an upper surface with recesses, each recess adapted to receive one plate so as to remove it from said stack, a given number of containers being able to simultaneously supply the same drum.

7. Apparatus as claimed in claim 1 wherein each cylinder comprises on its periphery a certain number of work stations operative during the transfer of parts, each work station cooperating with an upper cam and a lower cam acting on an upper tool by way of rollers transmitting a calibrated force, and a lower tool controlled by said lower cam by way of rollers acting on parts carried by the vehicles, the upper tool controlling a storage member acting on a memory sensor firmly attached to the cylinder.

8. Apparatus as claimed in claim 7 in which the memory sensor comprises a grooved cylindrical member accommodated for translational movement in a support casing of the cylinder, the sensor being driven downwards in different fashion in relation to the vehicle, according to whether or not the upper tool has effected its work movement, said sensor controlling the ejection of a part carried by the vehicle when the sensor does not occupy the correct position at the termination of said work movement.

9. Apparatus as claimed in claim 7 wherein said memory sensor comprises grooves into which there engage retention means, said sensor thus being maintained in a determined position in relation to the vehicle, while at the same time allowing the translation of the sensor when a given force is exerted thereupon.

* * * * *